US010750821B2

(12) United States Patent
Greene

(10) Patent No.: US 10,750,821 B2
(45) Date of Patent: Aug. 25, 2020

(54) ARTICLE OF FOOTWEAR WITH SPACED CUSHIONING COMPONENTS ATTACHED TO A GROUND-FACING SURFACE OF AN UPPER AND METHOD OF MANUFACTURING AN ARTICLE OF FOOTWEAR

(71) Applicant: NIKE, Inc., Beaverton, OR (US)

(72) Inventor: Pamela S. Greene, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 45 days.

(21) Appl. No.: 15/770,669

(22) PCT Filed: Nov. 2, 2016

(86) PCT No.: PCT/US2016/060067

§ 371 (c)(1),
(2) Date: Apr. 24, 2018

(87) PCT Pub. No.: WO2017/079256

PCT Pub. Date: May 11, 2017

(65) Prior Publication Data

US 2018/0303200 A1 Oct. 25, 2018

Related U.S. Application Data

(60) Provisional application No. 62/250,221, filed on Nov. 3, 2015.

(51) Int. Cl.
*A43B 13/20* (2006.01)
*A43B 13/12* (2006.01)
(Continued)

(52) U.S. Cl.
CPC ..... *A43B 13/20* (2013.01); *A43B 13/122* (2013.01); *A43B 13/184* (2013.01); *A43B 13/189* (2013.01); *A43B 13/223* (2013.01)

(58) Field of Classification Search
CPC ... A43B 13/122; A43B 13/184; A43B 13/189; A43B 13/20; A43B 13/223; F41H 5/08;
(Continued)

(56) References Cited

U.S. PATENT DOCUMENTS 4,183,156 A 1/1980 Rudy
4,219,945 A * 9/1980 Rudy ..... A43B 13/203 36/29

(Continued)

FOREIGN PATENT DOCUMENTS

CN 201213495 Y 4/2009
CN 201480174 U 5/2010
WO 2014110369 A1 7/2014

*Primary Examiner* — Anne M Kozak
(74) *Attorney, Agent, or Firm* — Quinn IP Law

(57) ABSTRACT

An article of footwear includes an upper, and multiple cushioning components that are attached to a ground-facing surface of the upper. The cushioning components are spaced apart from one another so that the ground-facing surface of the upper is exposed between the cushioning components and the cushioning components at least partially form a ground contact surface. At least one of the cushioning components includes a bladder element with a fluid-filled cavity. A method of manufacturing an article of footwear comprises attaching cushioning components to a ground-facing surface of an upper so that the cushioning components are spaced apart from one another, the ground-facing surface of the upper is exposed between the cushioning components, and the cushioning components at least partially form a ground contact surface, wherein at least one of the cushioning components includes a bladder element with a fluid-filled cavity.

16 Claims, 4 Drawing Sheets

(51) Int. Cl.
*A43B 13/18* (2006.01)
*A43B 13/22* (2006.01)

(58) Field of Classification Search
CPC . F41H 5/14; F41H 5/044; A41B 11/00; A41B 11/15; A41B 11/17
USPC ..... 36/29, 30 R; 2/239
See application file for complete search history.

(56) References Cited

U.S. PATENT DOCUMENTS 4,271,606 A 6/1981 Rudy
4,936,029 A 6/1990 Rudy
D310,131 S * 8/1990 Hase ..... D2/949
D310,132 S * 8/1990 Hase ..... D2/949
5,042,176 A 8/1991 Rudy
5,343,639 A * 9/1994 Kilgore ..... A43B 13/183 36/27
5,713,141 A 2/1998 Mitchell et al.
5,753,061 A * 5/1998 Rudy ..... A42B 3/121 156/147
5,784,807 A 7/1998 Pagel
D400,344 S * 11/1998 Avar ..... D2/954
5,878,510 A * 3/1999 Schoesler ..... A43B 7/147 36/153
5,952,065 A 9/1999 Mitchell et al.
6,013,340 A 1/2000 Bonk et al.
6,076,284 A * 6/2000 Terlizzi ..... A43B 13/16 36/103
6,082,025 A 7/2000 Bonk et al.
6,127,026 A 10/2000 Bonk et al.
6,138,281 A * 10/2000 Chiaruttini ..... A41B 11/00 2/239
6,203,868 B1 3/2001 Bonk et al.
6,226,896 B1 * 5/2001 Friton ..... A43B 13/26 36/25 R
6,233,846 B1 * 5/2001 Sordi ..... A43B 5/00 36/105
6,321,465 B1 11/2001 Bonk et al.
6,354,020 B1 * 3/2002 Kimball ..... A43B 13/203 36/135
6,453,577 B1 * 9/2002 Litchfield ..... A43B 13/203 36/29
6,487,796 B1 * 12/2002 Avar ..... A43B 5/00 36/114
6,851,204 B2 * 2/2005 Aveni ..... A43B 7/1465 36/114
6,895,693 B2 * 5/2005 Baruck ..... A43B 5/12 36/8.3
7,047,672 B2 5/2006 Hoffer et al.
7,337,558 B2 * 3/2008 Terlizzi ..... A43B 5/12 36/102
D607,185 S * 1/2010 Soon ..... D2/902
7,721,465 B2 5/2010 Marvin et al.
7,757,410 B2 * 7/2010 Aveni ..... A43B 13/181 36/28
7,793,524 B2 9/2010 Hsiao
8,220,077 B1 7/2012 Ott et al.
8,434,244 B2 5/2013 Litchfield et al.
D721,225 S * 1/2015 Bradford ..... D2/951
D747,596 S * 1/2016 Vestuti ..... D2/951
9,320,313 B2 * 4/2016 Craig ..... A43B 3/00
9,526,296 B2 * 12/2016 Langvin ..... A43B 5/00
9,743,709 B2 * 8/2017 Hesterberg ..... A43B 7/14
2004/0098882 A1 * 5/2004 Tuan ..... A43B 13/20 36/29
2004/0221483 A1 * 11/2004 Cartier ..... A43B 13/125 36/27
2004/0261293 A1 * 12/2004 Marvin ..... A43B 13/189 36/29
2005/0108901 A1 * 5/2005 Yamashita ..... A43B 13/188 36/113
2005/0144703 A1 7/2005 Hilbert
2005/0166427 A1 * 8/2005 Greene ..... A43B 7/1495 36/128
2005/0252038 A1 11/2005 Braunschweiler
2005/0283999 A1 * 12/2005 Whatley ..... A43B 13/20 36/29
2007/0033830 A1 * 2/2007 Chang ..... A43B 3/0052 36/28
2007/0033831 A1 * 2/2007 Aveni ..... A43B 13/186 36/28
2007/0107264 A1 * 5/2007 Meschter ..... A43B 23/227 36/76 R
2007/0107265 A1 * 5/2007 Mueller ..... A43B 13/16 36/91
2008/0010854 A1 * 1/2008 Sokolowski ..... A43B 7/1495 36/8.3
2008/0016720 A1 * 1/2008 Aveni ..... A43B 13/14 36/28
2008/0289223 A1 * 11/2008 Adrover Bernabeu .. A43B 3/16 36/102
2009/0013556 A1 * 1/2009 Nishiwaki ..... A43B 13/183 36/28
2009/0113603 A1 5/2009 Liu
2009/0126224 A1 * 5/2009 Greene ..... A43B 7/32 36/27
2009/0151195 A1 * 6/2009 Forstrom ..... A43B 13/20 36/29
2009/0165333 A1 * 7/2009 Litchfield ..... A43B 13/203 36/88
2010/0107444 A1 * 5/2010 Aveni ..... A43B 13/206 36/88
2010/0251565 A1 * 10/2010 Litchfield ..... A43B 13/181 36/28
2011/0277346 A1 * 11/2011 Peyton ..... A43B 13/122 36/29
2013/0031804 A1 * 2/2013 Abshire ..... A43B 7/145 36/103
2013/0167402 A1 * 7/2013 Christensen ..... A43B 13/184 36/29
2014/0196308 A1 * 7/2014 Baratta ..... A43B 13/184 36/29
2014/0202035 A1 * 7/2014 Goldman ..... A43B 7/12 36/84
2014/0215729 A1 * 8/2014 Curl ..... B29D 35/142 12/21
2014/0215857 A1 * 8/2014 Curl ..... B29D 35/148 36/134
2014/0230276 A1 8/2014 Campos, II et al.
2014/0259747 A1 * 9/2014 Baudouin ..... A43B 13/183 36/29
2014/0338090 A1 * 11/2014 Perkins ..... A41B 11/007 2/22
2015/0223564 A1 8/2015 Peyton et al.
2015/0257481 A1 * 9/2015 Campos, II ..... A43B 13/20 36/103
2015/0272271 A1 * 10/2015 Campos, II ..... A43B 13/189 36/29
2015/0305436 A1 * 10/2015 Doyle ..... A43B 13/203 36/43
2016/0192737 A1 * 7/2016 Campos, II ..... A43B 13/16 36/28
2017/0119095 A1 * 5/2017 Greene ..... B29D 35/142
2017/0266938 A1 * 9/2017 Hensley ..... A43B 13/189
2018/0220737 A1 * 8/2018 Piontkowski ..... A43B 13/145

* cited by examiner

ARTICLE OF FOOTWEAR WITH SPACED CUSHIONING COMPONENTS ATTACHED TO A GROUND-FACING SURFACE OF AN UPPER AND METHOD OF MANUFACTURING AN ARTICLE OF FOOTWEAR

CROSS-REFERENCE TO RELATED APPLICATION

This application claims the benefit of and is a National Stage entry of International Patent Application No. PCT/US2016/060067, filed Nov. 2, 2016, which claims the benefit under 35 U.S.C. 119(e) of priority to U.S. Provisional Application No. 62/250,221, filed Nov. 3, 2015, which is incorporated by reference in its entirety.

TECHNICAL FIELD

The present teachings generally include an article of footwear and a method of manufacturing an article of footwear.

BACKGROUND

Footwear typically includes a sole configured to be located under a wearer's foot to space the foot away from the ground or floor surface. Soles can be designed to provide a desired level of cushioning. Athletic footwear in particular sometimes utilizes polyurethane foam or other resilient materials in the sole to provide cushioning. Fluid-filled bladders are sometimes included in the sole to provide desired impact force absorption, motion control, and resiliency. The incorporation of additional materials and components adds processing steps to the manufacturing of footwear.

DESCRIPTION

Figure 1:
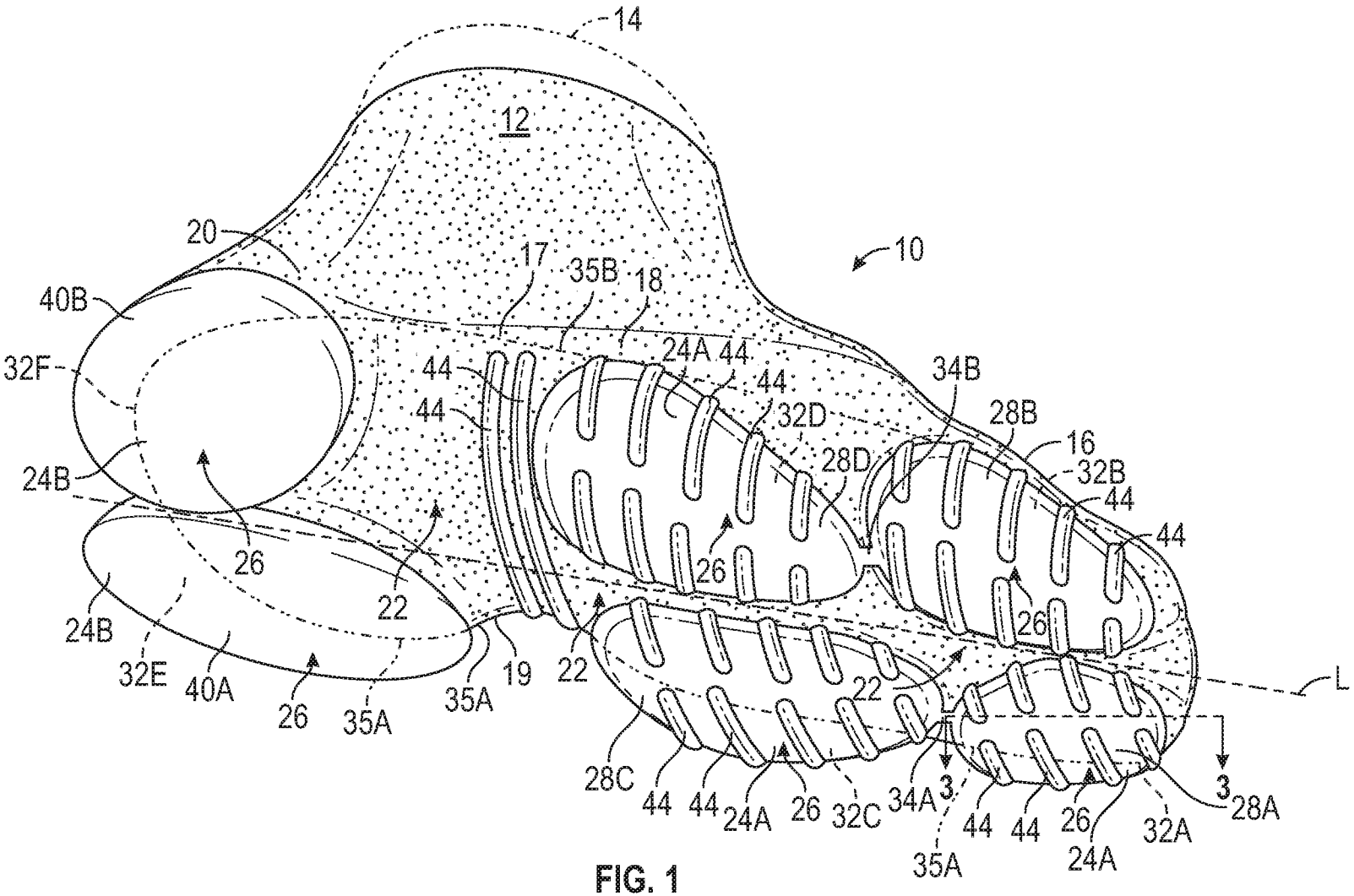
FIG. 1 is a schematic perspective illustration of a first embodiment of an article of footwear.

An article of footwear includes an upper and multiple cushioning components that are attached to a ground-facing surface of the upper. The cushioning components are spaced apart from one another so that the ground-facing surface of the upper is exposed between the cushioning components and the cushioning components at least partially form a ground contact surface. At least one of the cushioning components includes a bladder element with a fluid-filled cavity.

The upper may have many different configurations. In an embodiment, the upper is configured as a sock. Optionally, the sock upper may have no lacing system, and may be configured from a variety of flexible materials and components. For example, the upper may be a variety of textiles, assembled textiles, yarns, or both, and may be knitted, such as a circular knit or other 360 degree knit, or can be woven, or braided.

In various embodiments, the article of footwear may include a forefoot cushioning component and a heel cushioning component. Optionally, one or more additional cushioning components may be provided, such as at a midfoot portion of the upper. For example, in an embodiment expected to be used mainly on a hard ground surface, it may be desirable to provide support under an arch area of the foot by attaching one or more cushioning components to a midfoot portion of the upper.

In one embodiment that includes a heel cushioning component, the bladder element is a first bladder element, and the upper has a heel portion, a forefoot portion, and a midfoot portion between the heel portion and the forefoot portion. The cushioning components include the heel cushioning component attached to the heel portion of the upper. The heel cushioning component includes both the first bladder element and a second bladder element that is spaced either rearward of or laterally from the first bladder element. In an embodiment, that includes the forefoot cushioning component, the forefoot cushioning component is attached to the forefoot portion. The forefoot cushioning component includes both the first bladder element and a second bladder element spaced either rearward of or laterally from the first bladder element.

The article of footwear may include traction elements at the ground contact surface. For example, in one embodiment, the bladder element includes at least one traction element at the ground contact surface. In other words, the bladder element is formed to include an integral traction element. In such an embodiment, the traction element is the same material as the bladder element, such as but not limited to polyurethane. Alternatively, the traction element may be attached to the bladder element, such as with adhesive or by thermal bonding. These traction elements may additionally serve the function of reinforcing the upper and providing puncture or wear resistance to the underfoot area that is not separated from contact with elements commonly found on the ground by the cushioning components.

At least one traction element may be directly attached to the ground-facing surface of the upper between the cushioning components. On even ground, the ground-facing surface of the upper between the cushioning components is elevated from the ground by the cushioning components, and does not form part of the ground contact surface. On uneven ground, such as sand, the ground-facing surface of the upper between the cushioning components may contact the ground. Providing traction elements on this portion of the upper can increase traction in such an environment.

In some embodiments, the cushioning components are directly attached to the upper. For example, the upper surface of the cushioning components may be directly attached to the ground-facing surface of the upper, such as by adhesive or thermal bonding. In those cushioning components that include a bladder element, the upper surface of the bladder element may be directly attached to the ground-facing surface of the upper.

In one embodiment, the cushioning components include both a heel cushioning component attached to the heel portion, and a forefoot cushioning component attached to the forefoot portion. The ground-facing surface of the upper is exposed at the midfoot portion between the heel cushioning component and the forefoot cushioning component. At least one of the cushioning components includes a midsole layer positioned between the upper and the bladder element. For example, the midsole layer may be a foam material, such as but not limited to an ethylene vinyl acetate (EVA) or thermoplastic polyurethane (TPU) foams.

In various embodiments, the first bladder element is positioned between a medial extremity of the ground-facing surface of the upper and the second bladder element, and the second bladder element is positioned between a lateral extremity of the ground-facing surface of the upper and the first bladder element. The forefoot cushioning component may also include a third bladder element and a fourth bladder element in addition to the first and the second bladder element. The third bladder element is positioned between the medial extremity of the ground-facing surface and the fourth bladder element, and the fourth bladder element is positioned between the lateral extremity of the ground-facing surface and the third bladder element. The first and third bladder elements are in fluid communication with one another, and the second and fourth bladder elements are in fluid communication with one another.

The forefoot cushioning component may include a contiguous midsole layer attached to the upper and positioned between the upper and the first, the second, the third, and the fourth bladder elements. The first, the second, the third, and the fourth bladder elements are attached to the contiguous midsole layer. Optionally, the contiguous midsole layer is notched between the first and second bladder elements so that the ground-facing surface of the upper is exposed between the first and second bladder elements. The midsole layer may also be notched between the second and fourth bladder elements so that the ground-facing surface of the upper is exposed between the second and the fourth bladder elements. Configuring the midsole layer with notches in this manner increases the lateral flexibility of the forefoot cushioning component. In some embodiments that have a heel cushioning component, the heel cushioning component may also include a midsole layer, which may be contiguous, and may be positioned between the one or more bladder elements of the heel cushioning component, and the ground-facing surface of the upper.

A method of manufacturing an article of footwear includes attaching cushioning components to a ground-facing surface of an upper so that the cushioning components are spaced apart from one another, the ground-facing surface of the upper is exposed between the cushioning components, and the cushioning components at least partially form a ground contact surface. At least one of the cushioning components includes a bladder element with a fluid-filled cavity.

The method may include forming the bladder element with at least one traction element at the ground contact surface. Alternatively, the method may include attaching at least one traction element to the bladder element so that the at least one traction element further forms the ground contact surface. Moreover, the method may include attaching at least one traction element to the ground-facing surface of the upper between the cushioning components.

In an embodiment in which at least one of the cushioning components includes a midsole layer, attaching the cushioning components to the ground-facing surface of the upper includes attaching the midsole layer to the upper so that the midsole layer is positioned between the upper and the bladder element.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

Referring to the drawings wherein like reference numbers refer to like components throughout the several views, FIG. 1 shows an article of footwear 10. As shown, the article of footwear 10 is an athletic shoe, such as for sand soccer. In other embodiments, the article of footwear 10 could be for another category of footwear, such as a dress shoe, a work shoe, a sandal, a slipper, or a boot. The article of footwear 10 includes an upper 12 configured as a sock. The upper 12 is shown worn on a foot 14 shown in phantom. The upper 12 may include a variety of flexible materials such as yarns or textiles. The upper may be multiple pieces sewn or bonded to one another. For example, the upper 12 may be a variety of textiles, assembled textiles, yarns, or both, and may be knitted, such as a circular knit or other 360 degree knit, or can be woven, or braided. In the sock configuration shown, the upper 12 has no lacing system. In other embodiments, the upper 12 may have a lacing system.

The upper 12 extends under the foot 14 and has a ground-facing surface 22 at a forefoot portion 16, at a midfoot portion 18, and at a heel portion 20 of the upper 12. The forefoot portion 16 generally includes portions of the article of footwear 10 corresponding with the toes and the joints connecting the metatarsals with the phalanges of the foot 14. The midfoot portion 18 generally corresponds with an arch area of the foot 14, and extends from the forefoot portion 16 to the heel portion 20. The heel portion 20 generally corresponds with a rear portion of a human wearer's foot 14, including the calcaneus bone, with the foot 14 corresponding in size to the article of footwear 10. The article of footwear 10 shown is for a right foot. A pair of footwear includes the article of footwear 10, and an article of footwear for a left foot that is a mirror image of the article of footwear 10.

Figure 2:
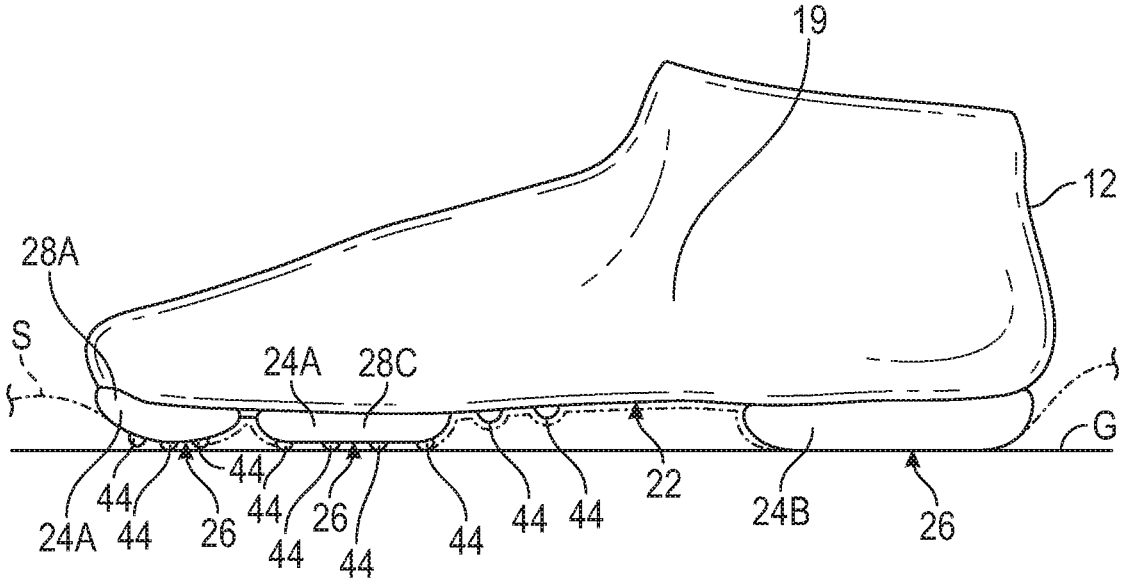
FIG. 2 is a schematic side view illustration of the article of footwear of FIG. 1 including multiple cushioning components attached to an upper.

The upper 12 has a lateral side 17 best shown in FIG. 1, and the medial side 19 best shown in FIG. 2. The lateral side 17 includes all portions of the upper 12 on a side of a longitudinal midline L of the upper 12 closest to a lateral side of the foot 14. The medial side 19 includes all portions of the upper 12 on a side of the longitudinal axis L closest to a medial side of the foot 14. The lateral side 17 of the upper 12 is a side that corresponds with the side of the foot 14 that is generally further from the other foot of the wearer (i.e., the side closer to the fifth toe of the wearer). The fifth toe is commonly referred to as the little toe. The medial side 19 of the upper 12 is the side that corresponds with an inside area of the foot 14 and is generally closer to the other foot of the wearer (i.e., the side closer to the hallux of the foot of the wearer). The hallux is commonly referred to as the big toe.

Multiple cushioning components 24A, 24B are attached to the ground-facing surface 22 of the upper 12. The cushioning component 24A is a forefoot cushioning component and is attached to the forefoot portion 16 of the upper 12. The cushioning component 24B is a heel cushioning component and is attached to the heel portion 20 of the upper 12. The cushioning components 24A, 24B are positioned on the upper 12 so that the ground-facing surface 22 of the upper 12 is exposed between the forefoot cushioning component 24A and the heel cushioning component 24B.

The cushioning components 24A, 24B are positioned under the upper 12 and form a ground contact surface 26 as shown in the medial side view of FIG. 2. On level ground G, the exposed portion of the ground-facing surface 22 of the upper 12 between the cushioning components 24A, 24B is elevated from the ground G by the cushioning components 24A, 24B and therefore does not form part of the ground-contact surface 26. The cushioning components 24A, 24B thus serve to isolate the upper 12 from temperatures of the ground G, and provide insulation from ground temperatures. For example, temperature ranges that may be encountered by athletes in sand are from less than 32 degrees Fahrenheit to 159 degrees Fahrenheit. Bladder elements of the cushioning components 24A, 24B provide a sealed airspace cavity that prevents thermal gain from hot surfaces and also prevents loss of heat through the underfoot from contact with cold surfaces. The bladder elements provide insulation from hot or cold surface temperatures unfavorable to athletic performance while still providing a desired level of cushioning.

On ground that is not level, such as sand S (shown with a phantom line in FIG. 2), even the exposed portion of the ground-facing surface 22 of the upper 12 between the cushioning components 24A, 24B may form part of the ground-contact surface 26. In an embodiment expected to be used mainly on a hard ground surface, it may be desirable to provide support under an arch area of the foot by attaching one or more cushioning components to a midfoot portion 18 of the upper 12. In any of these conditions, the cushioning components 24A, 24B isolate at least some portions of the upper 12 from the ground G or sand S. For example, the portions of the ground-facing surface 22 to which the cushioning components 24A, 24B are directly attached are covered by the cushioning components 24A, 24B and thus are always isolated from the ground G or sand S.

Referring to FIG. 1, each of the cushioning components 24A, 24B includes a bladder element. The forefoot cushioning component 24A has four bladder elements, including a first bladder element 28A, a second bladder element 28B, a third bladder element 28C, and a fourth bladder element 28D. The bladder elements 28A, 28B, 28C, 28D are directly attached to the ground-facing surface 22 of the upper 12, as best shown with respect to bladder element 28A in FIG. 3. The bladder elements 28A, 28B, 28C, 28D may be attached to the ground-facing surface 22 by adhesive or by thermal bonding. The layer of adhesive 30 is shown in FIG. 3.

Each bladder element 28A, 28B, 28C, 28D is formed from a polymeric material that bounds and defines a fluid-filled cavity 32A, 32B, 32C, 32D, respectively. For example, each bladder element 28A, 28B, 28C, 28D may comprise a thermoplastic polyurethane material (TPU). Optionally the TPU may be recyclable and regrindable, and may be made from recycled TPU, allowing the material of the bladder elements 28A, 28B, 28C, 28D to be recycled and reused.

Figure 5:
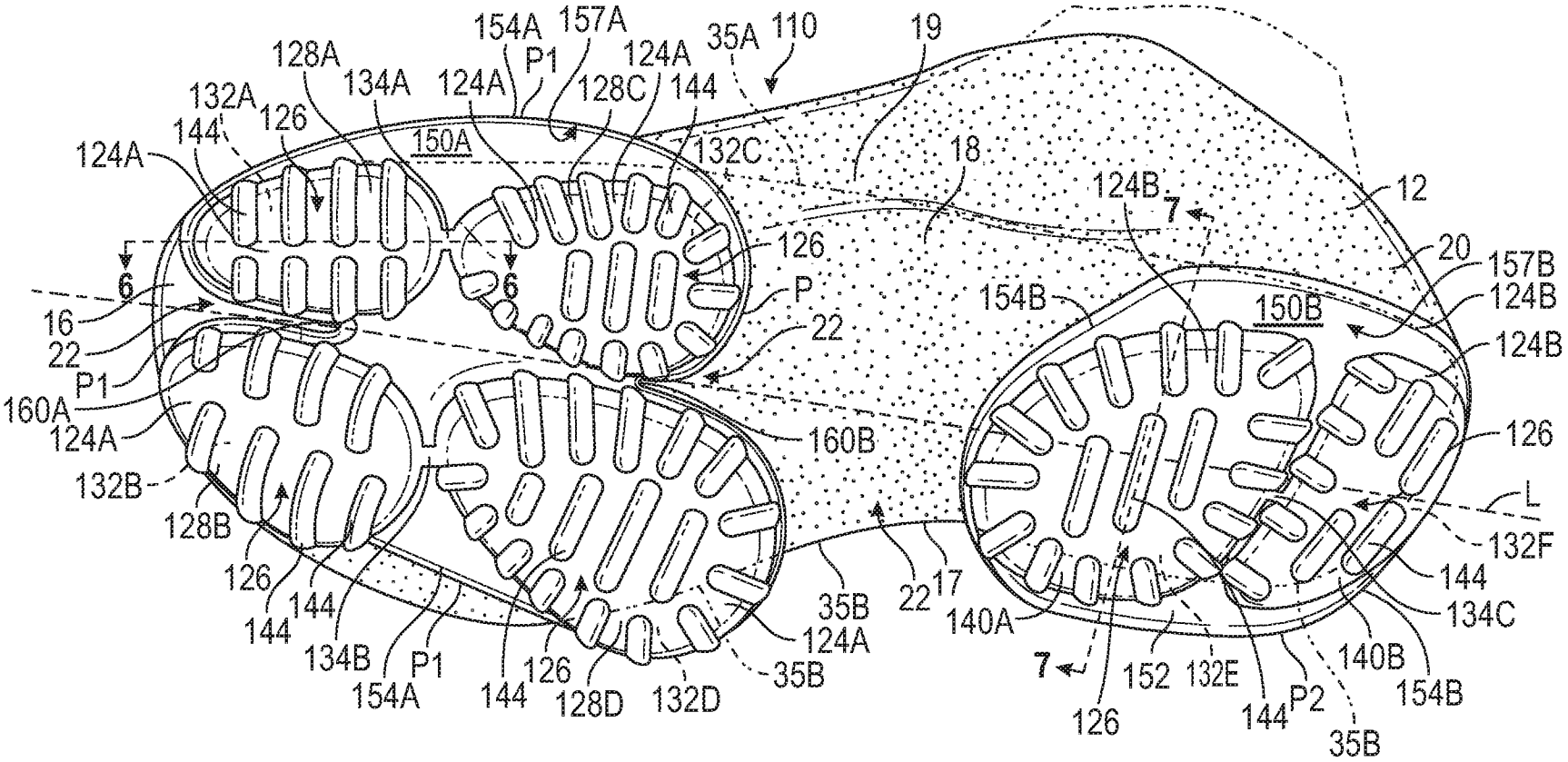
FIG. 5 is a schematic perspective illustration of a second embodiment of an article of footwear in accordance with an alternative aspect of the present teachings.
Figure 6:
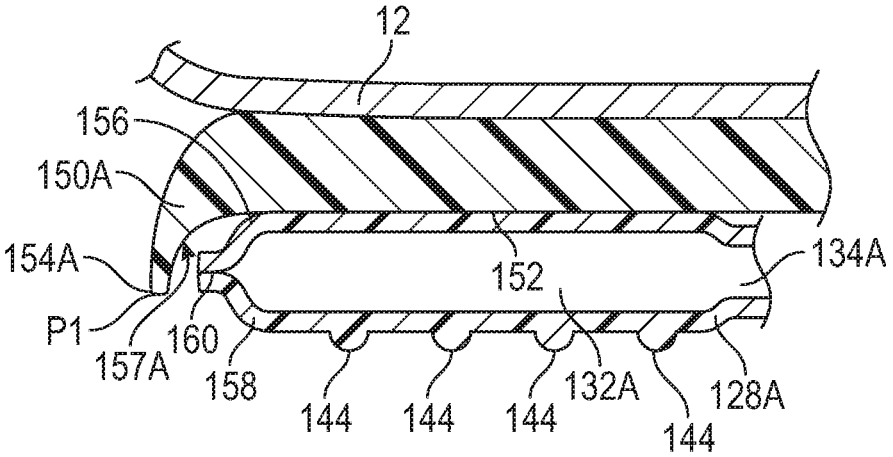
FIG. 6 is a schematic cross-sectional and fragmentary illustration of one of the cushioning components of FIG. 5 attached to the upper, taken at lines 6-6 in FIG. 5.

The bladder elements 28A, 28B, 28C, 28D may be blow molded or alternatively may be thermoformed from upper and lower sheets as described with respect to the article of footwear 110 of FIGS. 5 and 6. The sheets may have alternating layers of TPU and a gas barrier material. In all embodiments, the bladder elements 28A, 28B, 28C, 28D are configured to retain fluid within the fluid-filled cavities. As used herein, a "fluid" includes a gas, including air, an inert gas such as nitrogen, or another gas. Accordingly, "fluid-filled" includes "gas-filled". The various materials used for the bladder elements 28A, 28B, 28C, 28D, and other embodiments of bladder elements discussed herein, may be substantially transparent or may have a tinted color. For example, the bladder elements 28A, 28B, 28C, 28D can be formed from any of various polymeric materials that can retain a fluid at a predetermined pressure, including a fluid that is a gas, such as air, nitrogen, or another gas. For example, the bladder elements 28A, 28B, 28C, 28D can be a TPU material. The bladder elements 28A, 28B, 28C, 28D can be a urethane, polyurethane, polyester, polyester polyurethane, and/or polyether polyurethane.

Figure 3:
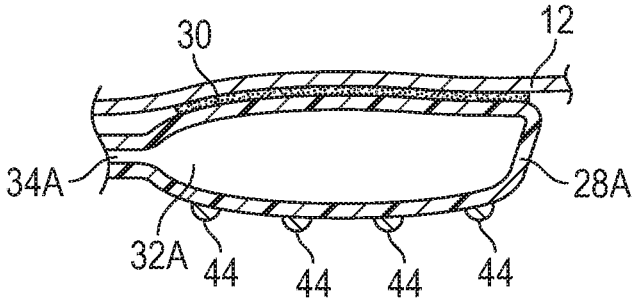
FIG. 3 is a schematic cross-sectional and fragmentary illustration of one of the cushioning components of FIG. 1 attached to the upper, taken at lines 3-3 in FIG. 1.

In the embodiment of FIG. 1, the first and third bladder elements 28A, 28C are in fluid communication with one another through a connecting channel 34A best shown in FIG. 3. The second and fourth bladder elements 28B, 28D are similarly in fluid communication through a connecting channel 34B. In the embodiment shown, the first and second bladder elements 28A, 28B are not in fluid communication with one another. The third and fourth bladder elements 28C, 28D are also not in fluid communication with one another. The first and fourth bladder elements 28A, 28D are not in fluid communication with one another, and the second and third bladder elements 28B, 28C are not in fluid communication with one another. Within the scope of the present teachings however, any or all of the bladder elements 28A, 28B, 28C, 28D may be in fluid communication with one another through the use of connecting channels. Additionally, either or both of the channels 34A, 34B can be sealed.

For example, the bladder elements 28A, 28C can be commonly inflated through an inflation port at the first bladder element 28A (not shown) when the channel 34A is open, and then the channel 34A can be sealed so that the bladder element 28A can be further inflated to a different pressure than bladder element 28C. Similarly, the bladder elements 28B, 28D can be commonly inflated through an inflation port at the second bladder element 28B (not shown) when the channel 34B is open, and then the channel 34B can be sealed so that the bladder element 28B can be further inflated to a different pressure than bladder element 28D.

The connecting channels 34A, 34B are integrally formed as part of the bladder elements in a mold assembly from the same polymeric material used to form the bladder elements when the bladder elements are created by blow molding or thermoforming. In other words, the connecting channel 34A is integrally formed with the first bladder element 28A and the third bladder element 28C, and the connecting channel 34B is integrally formed with the second bladder element 28B and the fourth bladder element 28D. By articulating the bladder elements 28A, 28C in this manner, and by articulating bladder elements 28C, 28D in this manner, fore-aft flexibility is improved relative to an embodiment with a single bladder element in place of bladder elements 28A, 28B, 28C, 28D.

The first bladder element 28A is positioned between a medial extremity 35A of the ground-facing surface 22 of the upper 12 and the second bladder element 28B. The second bladder element 28B is positioned between a lateral extremity 35B of the ground-facing surface 22 of the upper 12 and the first bladder element 28A. The third bladder element 28C is positioned between the medial extremity 35A of the ground-facing surface 22 of the upper 12 and the fourth bladder element 28D. The fourth bladder element 28D is positioned between the lateral extremity 35B of the ground-facing surface and the third bladder element. The first and third bladder elements 28A, 28C are positioned on a medial side 19 of the longitudinal midline L of the upper 12. The second and fourth bladder elements 28B, 28D are positioned on the lateral side 38 of the longitudinal midline L. The second bladder element 28B is thus spaced laterally from the first bladder element 28A, and the third bladder element 28C is spaced laterally from the fourth bladder element 28D. By positioning the first and second bladder elements 28A, 28B relative to one another and the medial and lateral extremities 35A, 35B, as described, with the ground-facing surface 22 exposed between the first and second bladder elements 28A, 28B, and positioning the third and fourth bladder elements 28C, 28D relative to one another as described, with the ground-facing surface 22 exposed between the third and fourth bladder elements 28C, 28D, the forefoot cushioning component 24A has greater flexibility in lateral movement than would a cushioning component with a single, larger bladder element covering the forefoot region, as the forefoot cushioning component 24A can flex relative to the longitudinal midline L on either side of the longitudinal midline L.

The heel cushioning component 24B also includes a first bladder element 40A and a second bladder element 40B. Both of the bladder elements 40A, 40B are directly attached to the ground-facing surface 22 of the upper 12, similarly as described with respect to the forefoot cushioning component 24A. The second bladder element 40B is laterally spaced from the first bladder element 40A such that the bladder elements 40A, 40B are on opposite sides of the longitudinal midline L. The first bladder element 40A is positioned between the medial extremity 35A of the ground-facing surface 22 and the second bladder element 40B. The second bladder element 40B is positioned between the lateral extremity 35B of the ground-facing surface 22 and the first bladder element 40A. Each of the bladder elements 40A, 40B forms a fluid-filled cavity similar to a fluid-filled cavity 32A of FIG. 3. In the embodiment shown, the fluid-filled cavities 32E, 32F of bladder elements 40A, 40B are not in fluid communication with one another. However, a connecting channel may be used similar to connecting channel 34A to place the fluid-filled cavities 32E, 32F in fluid communication with one another.

The connecting channel 34A is included as part of and integrally formed with the adjacent bladder elements 28A, 28C, and the connecting channel 34B is included as part of and integrally formed with the adjacent bladder elements 28B, 28D when the bladder elements are created by blow molding or thermoforming. Because of the connecting channel 34A, the bladder elements 28A and 28C can be simultaneously inflated via an inflation port (not shown) integrally formed in the bladder element 28A. For example, depending on how the bladder elements are formed, the inflation port can be blow molded, or can thermoformed at a seam between the sheets. Because of the connecting channel 34B, the bladder elements 28B and 28D can be simultaneously inflated via an inflation port (not shown) integrally formed in the bladder element 28B. The bladder elements 40A and 40B are separately inflated via separate inflation ports (not shown) integrally formed in the bladder element 40A and 40B, respectively. After inflation, the inflation ports in the bladder elements 28A, 28B, 40A and 40B are then sealed.

Optionally, either or both of the connecting channels 34A, 34B can be sealed, and one of the bladder elements connected by the sealed channels can be further inflated prior to sealing the inflation ports in order to establish different pressures that can be maintained in the bladder elements separated by the sealed channels. The inflation pressures selected and the relative inflation pressures, if differing pressures are desired, can be selected based on any or all of the expected activity for which the article of footwear 10 will be used, the characteristics of the ground surface on which the article of footwear is expected to be used, and a weight distribution map of a wearer or of an average wearer. For example, if the article of footwear 10 is expected to be used on sand S, especially if the sand is expected to be relatively loose or soft, the bladder elements 28A, 28B, 28C, 28D, 40A, and 40B may be inflated to a lower pressure than if the article of footwear 10 is expected to be used on a harder surface. A lower inflation pressure allows the bladder elements 28A, 28B, 28C, 28D, 40A, and 40B to deflect further under loading, creating a greater contact area with the sand S to increase traction.

As best shown in FIG. 1, traction elements 44 are attached to lower portions of the bladder elements 28A, 28B, 28C, 28D so that the traction elements 44 further form the ground contact surface 26 of the article of footwear 10. Only some of the traction elements are labelled with reference number 44 in FIG. 1. The traction elements 44 may be the same material as the bladder elements, such as TPU, or a different material. For example, the traction elements 44 may be rubber to provide increased durability. In the embodiment shown, the traction elements 44 are adhered to the bladder elements 28A, 28B, 28C, 28D. In other embodiments as discussed herein, traction elements can be integrally formed with the bladder elements.

Figure 4:
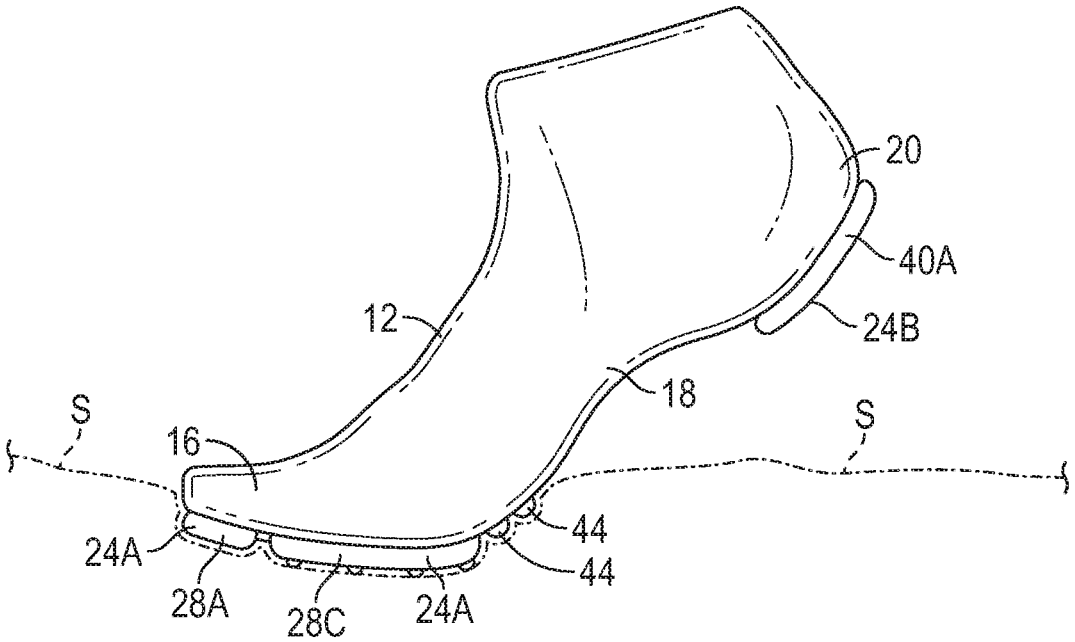
FIG. 4 is a schematic perspective illustration of the article of footwear of FIGS. 1 and 2 in a flexed position.

Additional traction elements 44 are directly attached to the exposed portion of the ground-facing surface 22 of the upper 12 between the forefoot cushioning component 24A and the heel cushioning component 24B. The traction elements 44 directly attached to the upper 12 provide additional traction to the article of footwear 10 such as when used on an uneven surface such as sand S. As shown in FIG. 4, when the article of footwear 10 is flexed, the traction elements 44 attached to the upper 12 are likely to contact the surface, whether ground G or sand S, thus providing additional traction. The traction elements 44 may be positioned only where needed for traction. For example the exposed portion of the ground-facing surface 22 nearest to the heel cushioning component 24B has no traction elements. The heel cushioning component 24B also has no traction elements. If the article of footwear 10 is used for particular sports, in which the wearer's weight is likely to be shifting to the forefoot portion of the foot 14, with the heel portion 20 often lifted as shown in FIG. 4, the heel cushioning component 24B and the rearmost portion of the exposed ground-facing surface 22 is less likely to be used or needed for tractive purposes. Accordingly, material is saved and weight is reduced by providing such portions free from any traction elements 44. However, traction elements 44 may be disposed on the heel cushioning component 24B and other portions of the ground-facing surface 22 if desired in other embodiments.

The traction elements 44 are shown positioned in only one pattern, array, arrangement, configuration or lay-out in FIG. 1; however a variety of different patterns arrays, arrangements, configurations or lay-outs may be used. For example, the traction elements 44 can be generally laterally extending, can extend only partway across the respective bladder element, can be staggered, can be generally straight, can be wavy, or otherwise configured and arranged to provide optimal cushioning, natural motion flexibility, stability and protection from the ground. The pattern of the traction elements 44 as well as the hardness and the thickness of the traction elements 44 can be selected based upon a particular ground surface the article of footwear 10 is expected to be used on. For example, if the article of footwear 10 is for an activity that takes place on relatively hard sand S or on relatively hard level ground that is not sand, one pattern, hardness, and thickness of the traction elements 44 can be selected, and another pattern, hardness, and thickness can be selected for use on soft or loose sand.

FIGS. 5 and 6 show another embodiment of an article of footwear 110 that has many of the same features as the article of footwear 10. Components that are the same are indicated with identical reference numbers and are as described with respect to FIG. 1-5. The article of footwear 110 has multiple cushioning components 124A, 124B attached to the ground-facing surface 22 of the upper 12. The cushioning component 124A is a forefoot cushioning component and is attached to the forefoot portion 16 of the upper 12. The cushioning component 124B is a heel cushioning component and is attached to the heel portion 20 of the upper 12. The ground-facing surface 22 of the upper 12 is exposed at the midfoot portion 18 of the upper 12 between the forefoot cushioning component 124A and the heel cushioning component 124B.

The cushioning components 124A, 124B are positioned under the upper 12 and form a ground contact surface 126. Similar to the ground contact surface 26 of FIG. 2, when on level ground G, the exposed portion of the ground-facing surface 22 of the upper 12 between the cushioning components 124A, 124B is elevated from the ground G by the cushioning components 124A, 124B and does not form part of the ground-contact surface 126. The cushioning components 124A, 124B thus serve to isolate the upper 12 from the temperature of the ground G, and allow heat dissipation through the exposed portion of the ground-contact surface 26. On ground that is not level, such as the sand S of FIG. 2, even the exposed portion of the ground-facing surface 22 may form part of the ground-contact surface 126. In any of these conditions, the cushioning components 124A, 124B isolate at least some portions of the upper 12 from the ground G or sand S. The portions of the ground-facing surface 22 to which the cushioning components 124A, 124B are directly attached are covered by the cushioning components 124A, 124B and are thus completely isolated from the ground G or sand S.

Referring to FIG. 5, each of the cushioning components 124A, 124B includes a bladder element. The forefoot cushioning component 124A has four bladder elements, including a first bladder element 128A, a second bladder element 128B, a third bladder element 128C, and a fourth bladder element 128D. The heel cushioning component 124B has a first bladder element 140A and a second bladder element 140B positioned rearward of the first bladder element 140B. As used herein, "rearward" means further from the forefoot portion 16.

The cushioning components 124A, 124B each have a midsole layer 150A, 150B, respectively. The midsole layer 150A is positioned between the bladder elements 128A, 128B, 128C, 128D and the upper 12, and the midsole layer 150B is positioned between the bladder elements 140A, 140B and the upper 12. The midsole layers 150A, 150B can be foam, such as ethylene vinyl acetate (EVA) or thermoplastic polyurethane (TPU) foam, and/or other materials or components, to provide predetermined, desirable lateral/shear resistance dynamics and desired compliance under loading in the vertical direction. The bladder elements 128A, 128B, 128C, 128D are secured to a lower side 152 of the midsole layer 150A, as shown in FIG. 6. The bladder elements 128A, 128B, 128C, 128D can be secured to the midsole layer 150A by adhesive or by thermal bonding. For example, if the bladder elements 128A, 128B, 128C, 128D are thermoformed, the midsole layer 150A and the bladder elements 128A, 128B, 128C, 128D can be thermally bonded to one another by placing the midsole layer 150A in a thermoforming mold adjacent polymeric sheets 156, 158 used to thermoform the bladder elements 128A, 128B, 128C, 128D. Optionally, the midsole layers 150A, 150B could be directly injected or deposited onto the polymeric sheets 156, 158 using polymers with favorable co-adhesion properties, such as polyurethanes and/or thermoplastic polyurethanes (TPUs).

Figure 7:
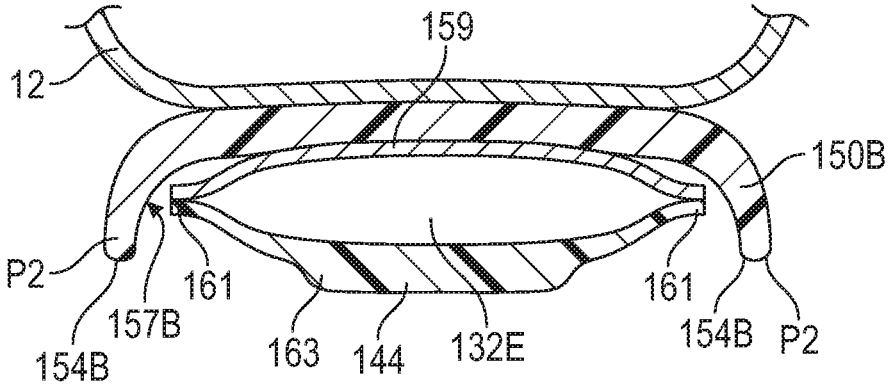
FIG. 7 is a schematic cross-sectional and fragmentary illustration of one of the cushioning components of FIG. 5 attached to the upper, taken at lines 7-7 in FIG. 5.

As best shown in FIGS. 5 and 6, the midsole layer 150A has a rim 154A extending around the perimeter P1 of the midsole layer 150A away from the upper 12. The rim 154A is configured similar to an outrigger and may be referred to as an outrigger rim. The midsole layer 150A thus has a generally concave ground-facing surface 157A to which the bladder elements 128A, 128B, 128C, and 128D are attached. The concave ground-facing surface 157A and the rim 154A help to trap the sand S shown in FIG. 2, providing additional stabilizing contact between the midsole layer 150A and the sand S, and enabling greater ability to push off of the sand S during use. As shown in FIG. 7, the midsole layer 150B has a similar rim 154B around its perimeter P2, also serving to trap the sand S and providing a generally concave ground-facing surface 157B for enhanced push-off from the sand S.

The midsole layer 150A is contiguous. In other words, the midsole layer 150A is a single unitary component. The midsole layer 150A extends over a side of each of the bladder elements 128A, 128B, 128C, 128D opposite to the side forming the ground-contact surface 126. In other embodiments, the midsole layer 150A could be discrete, discontinuous portions each of which extends over one or more but not all of the bladder elements 128A, 128B, 128C, 128D. The rim 154A configured similar to an outrigger can also be formed as a contiguous extension of the bladder elements 128A, 128B, 128C, 128D.

The midsole layer 150A is directly attached to the ground-facing surface 22 of the upper 12 such as but not limited to by adhesive, thermal bonding, radio-frequency welding, or direct injection onto the upper 12. The bladder elements 128A, 128B, 128C, 128D are thus not directly attached to the ground-facing surface 22 of the upper 12, as best shown with respect to bladder element 128A in FIG. 6. In FIG. 6, the bladder element 128A is thermally-bonded to the midsole layer 150A without adhesive. The bladder element 128 is thermoformed from an upper polymeric sheet 156 and a lower polymeric sheet 158 bonded to one another during thermoforming when compressed together at a peripheral seam 160. Alternatively, the bladder elements 128A, 128B, 128C, 128D may be blow molded from a polymeric material, that may include a thermoplastic polyurethane (TPU).

Similarly to bladder elements 28A, 28B, 28C, 28D, each bladder element 128A, 128B, 128C, 128D is formed from a polymeric material that bounds and defines a fluid-filled cavity 132A, 132B, 132C, 132D. For example, each bladder element 128A, 128B, 128C, 128D may comprise a TPU material that may be recyclable and regrindable, and may be made from recycled TPU. The bladder elements 128A, 128B, 128C, 128D are configured to retained fluid within the fluid-filled cavities 132A, 132B, 132C, 132D, such as nitrogen or air. For example, the bladder elements 128A, 128B, 128C, 128D can be formed from any of various polymeric materials that can retain a fluid at a predetermined pressure. For example, the bladder elements 128A, 128B, 128C, 128D can be a TPU material. The bladder elements 128A, 128B, 128C, 128D can be a urethane, polyurethane, polyester, polyester polyurethane, and/or polyether polyurethane.

Moreover, in one embodiment, the bladder elements 128A, 128B, 128C, 128D may be formed of one or more sheets, such as sheets 156, 158, having layers of different materials. The sheets may be laminate membranes formed from thin films having one or more first layers that comprise thermoplastic polyurethane layers and that alternate with one or more second layers, also referred to herein as barrier layers, gas barrier polymers, or gas barrier layers. For example, the second layers may comprise a copolymer of ethylene and vinyl alcohol (EVOH) that is impermeable to the pressurized fluid contained therein as disclosed in U.S. Pat. No. 6,082,025 to Bonk et al., which is incorporated by reference in its entirety. The first layer may be arranged to form an outer surface of the polymeric sheet. That is, the outermost first layer may be the outer surface of the first bladder element 128A. Any or all of the bladder 128A, 128B, 128C, 128D may be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. Any or all of the bladder 128A, 128B, 128C, 128D may also be a flexible microlayer membrane that includes alternating layers of a gas barrier polymer material such as second layers and an elastomeric material such as first layers, as disclosed in U.S. Pat. Nos. 6,082,025 and 6,127,026 to Bonk et al. which are incorporated by reference in their entireties. In one non-limiting example, with such alternating layers, for example, the bladder element 128A, or any of the additional bladder elements discussed herein, may have a gas transmission rate for nitrogen of less than 10 cubic centimeters per square meter per atmosphere per day, or of less than 1 cubic centimeter per square meter per atmosphere per day. Additional suitable materials for the bladder element 128A are disclosed in U.S. Pat. Nos. 4,183,156 and 4,219,945 to Rudy which are incorporated by reference in their entireties. Further suitable materials for the bladder element 128A include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the bladder element 128A, engineering properties such as tensile strength, stretch properties, fatigue characteristics, dynamic modulus, and loss tangent can be considered. The thicknesses of the first and second polymeric sheets 156, 158 used to form the bladder element 128A can be selected to provide these characteristics.

FIG. 7 illustrates one method of manufacturing the bladder elements to include integral traction elements. For example, the bladder element 140A has a lower portion 163 that is injection molded to include an integral traction element 144. Injection molding the lower portion 163 allows a greater thickness of the integral traction element 144. An upper portion 159 of the bladder element 140A can be welded to a flange 161 of the lower portion 163, such as by compression and thermal bonding in a mold assembly. The method of injection molding a portion with integral traction elements as described with respect to bladder element 140A can be used on any of the bladder elements of the article of footwear 10 or 110.

In the embodiment of FIG. 5, the fluid-filled cavities 132A, 132C of the first and third bladder elements 128A, 128C are in fluid communication with one another through a connecting channel 134A best shown in FIG. 6. The fluid-filled cavities 132B, 132D of the second and fourth bladder elements 128B, 128D are similarly in fluid communication with one another through a connecting channel 134B. In the embodiment shown, the fluid-filled cavities 132A, 132C are not in fluid communication with one another. The fluid-filled cavities 132B, 132D are also not in fluid communication with one another. The first and fourth fluid-filled cavities 132A, 132D are not in fluid communication with one another, and the second and third fluid-filled cavities 132B, 132C are not in fluid communication with one another. Within the scope of the present teachings however, any or all of the fluid-filled cavities 132A, 132B, 132C, 132D may be in fluid communication with one another through the use of connecting channels.

The connecting channel 134A is included as part of and integrally formed with the adjacent bladder elements 128A, 128C in the case of cushioning component 124A, and the connecting channel 134B is included as part of and integrally formed with the adjacent bladder elements 128B, 128D when the bladder elements 128A, 128B, 128C, 128D are created by blow molding or thermoforming. The connecting channel 134C is included as part of and integrally formed with the adjacent bladder elements 140A, 140B when the bladder elements 140A, 140B are created by blow molding or thermoforming.

Because of the connecting channel 134A, the bladder elements 128A and 128C can be simultaneously inflated via an inflation port (not shown) integrally formed in the bladder element 128A. For example, depending on how the bladder elements are formed, the inflation port can be blow molded, or can thermoformed at a seam between the sheets. Because of the connecting channel 134B, the bladder elements 128B and 128D can be simultaneously inflated via an inflation port (not shown) integrally formed in the bladder element 128B. Because of the connecting channel 134C, the bladder elements 140A and 140B can be simultaneously inflated via an inflation port (not shown) integrally formed in the bladder element 140B. After inflation, the inflation ports in the bladder elements 128A, 128B, and 140B are then sealed.

Optionally, any or all of the channels 134A, 134B, 134C can be sealed, allowing different pressures to be maintained in the bladder elements separated by the sealed channels. For example, the bladder elements 128A, 128C can be commonly inflated through an inflation port at the first bladder element 128A (not shown) when the channel 134A is open, and then the channel 134A can be sealed so that the bladder element 128A can be further inflated to a different pressure than bladder element 128C. Similarly, the bladder elements 128B, 128D can be commonly inflated through an inflation port at the second bladder element 128B (not shown) when the channel 134B is open, and then the channel 134B can be sealed so that the bladder element 128B can be further inflated to a different pressure than bladder element 128D.

The first bladder element 128A is positioned between the medial extremity 35A of the ground-facing surface 22 of the upper 12 and the second bladder element 128B. The second bladder element 128B is positioned between the lateral extremity 35B of the ground-facing surface 22 of the upper 12 and the first bladder element 128A. The third bladder element 128C is positioned between the medial extremity 35A of the ground-facing surface 22 of the upper 12 and the fourth bladder element 128D. The fourth bladder element 128D is positioned between the lateral extremity 35B of the ground-facing surface 22 of the upper 12 and the third bladder element 128C. The first and third bladder elements 128A, 128C are positioned on the medial side 19 of the longitudinal midline L of the upper 12. The second and fourth bladder elements 128C, 128D are positioned on the lateral side 17 of the longitudinal midline L. The second bladder element 128B is thus spaced laterally from the first bladder element 128A, and the third bladder element 128C is spaced laterally from the fourth bladder element 128D. By positioning the first and second bladder elements 128A, 128B relative to one another and the medial and lateral extremities 35A, 35B, as described, with the ground-facing surface 22 exposed between the first and second bladder elements 128A, 128B, and positioning the third and fourth bladder elements 128C, 128D relative to one another as described, with the ground-facing surface 22 exposed between the third and fourth bladder elements 128C, 128D, the forefoot cushioning component 124A has greater flexibility in lateral movement than would a cushioning component with a single, larger bladder element covering the forefoot region, as the forefoot cushioning component 124A can flex relative to the longitudinal midline L on either side of the longitudinal midline L. It should be appreciated that the bladder elements may be referred to in another order. For example, the bladder element 128C, which is spaced rearward of the first bladder element 128A, may be referred to as the second bladder element.

Additionally, the contiguous midsole layer 150A is notched between the first and second bladder elements 128A, 128B and between the third and fourth bladder elements 128C, 128D along the longitudinal midline L. As shown in FIG. 5, a first notch 160A in a perimeter P1 of the midsole layer 150A is between the first and second bladder elements 128A, 128B. A second notch 160B in the perimeter P1 is between the third and fourth bladder elements 128C, 128D. Stated differently, the midsole layer 150A is bifurcated between the first and second bladder elements 128A, 128B, and between the third and fourth bladder elements 128C, 128D. The notches 160A, 160B cause the ground-facing surface 22 of the upper 12 to be exposed between the first and second bladder elements 128A, 128B, and between the third and fourth bladder elements 128C, 128D. The notches 160A, 160B also allow greater flexibility in lateral movement as the portion of the midsole layer 150A on the medial side 19 of the longitudinal midline L can flex more easily relative to the portion of the midsole layer 150B on the lateral side 17 of the longitudinal midline than if the midsole layer 150B did not have notches in the perimeter P1 where indicated.

The heel cushioning component 124B also includes a first bladder element 140A and a second bladder element 140B. A contiguous midsole layer 150B is positioned between the bladder elements 140A, 140B and the upper 12. The midsole layer 150B is directly attached to the ground-facing surface 22 of the upper 12, and the bladder elements 140A, 140B are attached to the midsole layer 150B similarly as described with respect to the attachment of the bladder elements 128A, 128B, 128C, 128D to the midsole layer 150A.

Each of the bladder elements 140A, 140B forms a fluid-filled cavity 132E, 132F, respectively. In the embodiment shown, the fluid-filled cavities 132E, 132F are in fluid communication with one another through a connecting channel 134C. The second bladder element 140B is spaced rearward from the first bladder element 140B. With this articulated arrangement of the bladder elements 140A, 140B, fore-aft flexing of the heel cushioning component 124B is improved relative to an embodiment with a single bladder element in place of bladder elements 140A, 140B. The bladder elements 140A, 140B can be commonly inflated through a trimmable and discardable inflation port at the bladder element 140B (not shown) shown in trimmed and discarded configuration) when the channel 134C is open, and then the channel 134C can be sealed so that the bladder element 140B can be further inflated to a different pressure than bladder element 140A.

The lower portions of the bladder elements 128A, 128B, 128C, 128D, 140A, 140B in include integrally formed traction elements 144. The traction elements 144 further form the ground contact surface 126. The traction elements 144 are the same material as the bladder elements 128A, 128B, 128C, 128D, such as TPU. For example, if the bladder elements 128A, 128B, 128C, 128D are thermoformed from upper and lower sheets 156, 158 shown in FIG. 6, then the traction elements 144 result from the shape of the mold assembly used to form the lower sheet 158.

The embodiment of FIGS. 5 and 6 has no additional traction elements directly attached to the exposed portion of the ground-facing surface 22 of the upper 12. Unlike the embodiment of FIG. 1, the heel cushioning component 124B has traction elements 144. The article of footwear 110 may be most appropriate for activities in which it is expected that the heel cushioning component 124B will be in contact with the ground G or sand S during the majority of use, and not in a flexed position as frequently as the article of footwear 10.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. An article of footwear comprising:

an upper;

multiple cushioning components attached to a ground-facing surface of the upper, at least one of the cushioning components including a bladder element with a fluid-filled cavity, the multiple cushioning components spaced apart from one another so that the ground-facing surface of the upper forms an outermost surface of the upper that is exposed from a medial extremity of the ground-facing surface of the upper to a lateral extremity of the ground-facing surface of the upper to be viewable from a bottom of the article of footwear between the cushioning components, and the bladder element at least partially forms a ground contact surface;

wherein:

the at least one of the cushioning components includes a midsole layer positioned between the upper and the bladder element;

the midsole layer has a rim at a perimeter, the rim extending away from the upper toward the ground contact surface of the bladder element, and a ground-facing surface of the midsole layer is concave;

the midsole layer is attached to the ground-facing surface of the upper; and the bladder element is attached to the concave ground-facing surface of the midsole layer and is spaced inward from the rim so that the concave ground-facing surface of the midsole layer is exposed to be viewable from the bottom of the article of footwear between the rim and the bladder element.

2. The article of footwear of claim 1, wherein the bladder element includes at least one traction element at the ground contact surface.

3. The article of footwear of claim 2, wherein the at least one traction element comprises thermoplastic polyurethane.

4. The article of footwear of claim 1, further comprising:

at least one traction element attached to the bladder element so that the at least one traction element further forms the ground contact surface.

5. The article of footwear of claim 1, wherein:

the upper has a heel portion, a forefoot portion, and a midfoot portion between the heel portion and the forefoot portion;

the cushioning components include a heel cushioning component attached to the heel portion, and a forefoot cushioning component attached to the forefoot portion; and the ground-facing surface of the upper that forms the outermost surface of the upper is exposed to be viewable from the bottom of the article of footwear at the midfoot portion between the heel cushioning component and the forefoot cushioning component.

6. The article of footwear of claim 1, wherein:

the bladder element is a first bladder element;

the upper has a heel portion, a forefoot portion, and a midfoot portion between the heel portion and the forefoot portion;

the cushioning components include a heel cushioning component attached to the heel portion; and the heel cushioning component includes both the first bladder element and a second bladder element spaced either rearward of or laterally from the first bladder element.

7. The article of footwear of claim 1, wherein:

the bladder element is a first bladder element;

the upper has a heel portion, a forefoot portion, and a midfoot portion between the heel portion and the forefoot portion;

the cushioning components include a forefoot cushioning component attached to the forefoot portion; and the forefoot cushioning component includes both the first bladder element and a second bladder element spaced either rearward of or laterally from the first bladder element.

8. The article of footwear of claim 7, wherein the first bladder element is positioned between the medial extremity of the ground-facing surface of the upper and the second bladder element, and the second bladder element is positioned between the lateral extremity of the ground-facing surface of the upper and the first bladder element.

9. The article of footwear of claim 8, wherein:

the forefoot cushioning component further includes a third bladder element and a fourth bladder element;

the third bladder element is positioned between the medial extremity of the ground-facing surface of the upper and the fourth bladder element, and the fourth bladder element is positioned between the lateral extremity of the ground-facing surface of the upper and the third bladder element;

the first bladder element and the third bladder element are in fluid communication with one another; and the second bladder element and the fourth bladder element are in fluid communication with one another.

10. The article of footwear of claim 9, wherein:

the midsole layer is included in the forefoot cushioning component and is a contiguous midsole layer attached to the upper and positioned between the upper and the first, the second, the third, and the fourth bladder elements; and the first, the second, the third, and the fourth bladder elements are attached to the contiguous midsole layer.

11. The article of footwear of claim 10, wherein the contiguous midsole layer is notched between the first and second bladder elements and between the third and fourth bladder elements so that the ground-facing surface of the upper is exposed to be viewable from the bottom of the article of footwear between the first and second bladder elements and between the third and fourth bladder elements.

12. The article of footwear of claim 1, wherein the upper is configured as a sock.

13. A method of manufacturing an article of footwear comprising:

attaching cushioning components to a ground-facing surface of an upper so that the cushioning components are spaced apart from one another, wherein at least one of the cushioning components includes a bladder element with a fluid-filled cavity, the ground-facing surface of the upper forms an outermost surface of the upper that is exposed from a medial extremity of the ground-facing surface of the upper to a lateral extremity of the ground-facing surface of the upper to be viewable from a bottom of the article of footwear between the cushioning components, and the bladder element at least partially forms a ground contact surface;

wherein the at least one of the cushioning components further includes a midsole layer, and said attaching the cushioning components to the ground-facing surface of the upper includes:

attaching the midsole layer to the upper; wherein the midsole layer has a rim at a perimeter, the rim extending away from the upper toward the ground contact surface of the bladder element, and a ground-facing surface of the midsole layer is concave; and attaching the bladder element to the ground-facing surface of the midsole layer with the bladder element spaced inward from the rim so that the midsole layer is positioned between the upper and the bladder element and the concave ground-facing surface of the midsole layer is exposed to be viewable from the bottom of the article of footwear between the rim and the bladder element.

14. The method of claim 13, further comprising:

forming the bladder element with at least one traction element at the ground contact surface.

15. The method of claim 13, further comprising:

attaching at least one traction element to the bladder element so that the at least one traction element further forms the ground contact surface.

16. The method of claim 13, further comprising:

attaching at least one traction element to the ground-facing surface of the upper between the cushioning components.

* * * * *